United States Patent [19]

Booz et al.

[11] 4,115,107

[45] Sep. 19, 1978

[54] METHOD OF PRODUCING METAL FLAKE

[75] Inventors: Albert David Booz, New Kensington; Thomas J. Kondis, Pittsburgh, both of Pa.

[73] Assignee: Aluminum Company of America, Pittsburgh, Pa.

[21] Appl. No.: 750,504

[22] Filed: Dec. 14, 1976

[51] Int. Cl.[2] ..... B22F 9/00

[52] U.S. Cl. ..... 75/0.5 R; 75/0.5 A; 75/0.5 B

[58] Field of Search ..... 75/0.5 R, 0.5 A, 0.5 B

[56] References Cited

U.S. PATENT DOCUMENTS

| | | | |
|---|---|---|---|
| 3,816,080 | 6/1974 | Bomford et al. | 75/0.5 R |
| 3,901,688 | 8/1975 | Casey et al. | 75/0.5 A |
| 3,941,584 | 3/1976 | Tundermann et al. | 75/0.5 A |
| 3,963,482 | 6/1976 | Kondis | 75/0.5 R |
| 3,988,146 | 10/1976 | Kondis | 75/0.5 A |

*Primary Examiner*—W. Stallard

*Attorney, Agent, or Firm*—Andrew Alexander

[57] ABSTRACT

A method of making metal flake comprises feeding metal particles, lubricant and gas to a vibratory mill, milling the metal particles to form metal flake and removing the metal flake from the mill. In addition, the method comprises removing the gas from the mill at a rate substantially commensurate with its feed rate.

23 Claims, 3 Drawing Figures

METHOD OF PRODUCING METAL FLAKE

INTRODUCTION

This invention relates to matal flake and more particularly it relates to the production of metal flake from metal particles such as metal powder.

Because of the interest in using metal flake, e.g. aluminum flake as a sensitizer for explosives, considerable research has been done to develop highly economical methods for its manufacture. In the prior art, aluminum flake has been produced by various methods. Some of these methods include rotary ball mills wherein the milling media is lifted by the rotation of the mill and permitted to drop on the metal particles, thereby providing metal flake. In this method of milling, the charge can be dry or wet. In the dry method, gas is passed through the mill at a rate sufficiently high to remove the flake. High flow rates of gas through the mill, however, can result in dust explosions. This method of removal of flake has other serious drawbacks. For example, only finely divided particles are removed from the mill. Thus, there can be a build-up of larger particles, requiring stopping of the mill for their removal. It will be understood that dry milling can also result in a welding effect, and thus increase the quality of larger particles. In the wet method, the charge is maintained in a slurry during the milling process. However, the wet method requires removal of the liquid carrier and drying of the product flake, which can result in unfavorable economics.

Thus, there is a need for a milling process where the milling atmosphere is controlled to eliminate hazards such as explosions and at the same time provide low cost, high volume product by elimination of as many steps as possible.

The present invention solves the problems encountered in prior art metal flake production and permits the production of metal flake in a highly economical manner.

SUMMARY OF THE INVENTION

An object of this invention is the production of metal flake.

Another object of this invention is the production of aluminum flake from aluminum particles.

A further object of this invention is the production of aluminum flake under controlled oxidizing conditions.

And a further object of this invention is the production of metal flake in a vibratory mill.

And yet a further object of this invention is the production of metal flake in a vibratory mill without accumulation of large particles within the mill.

These and other objects will become apparent from the drawings, specification and claims appended hereto.

In accordance with these objectives, a method of making or forming metal flake comprises feeding a charge of metal particles, lubricant and gas containing $O_2$ and an inert gas to a vibratory ball mill, milling the particles in the presence of the gas and removing metal flake from the mill. In an alternate embodiment, the metal particles, lubricant and an inert gas can be fed to the mill in the presence or absence of other gaseous vapors, whereby constituents of either the lubricant or of the gaseous vapors are capable of chemically combining with the metal surface to effect comminution, and thereafter carefully exposing the resultant pyrophoric metal flake particles to $O_2$ in order to form an oxide coating and render the particles non-pyrophoric. The method further comprises removing the gas from the mill at a rate substantially commensurate with its feed rate.

DETAILED DESCRIPTION OF THE PREFERRED EMBODIMENTS

Metal flake is made by feeding a charge of metal particles, lubricant, gas containing $O_2$ and $N_2$ in controlled amounts to a vibratory ball mill, milling the particles and removing metal flake therefrom. In a preferred embodiment, the metal flake and gas are removed at rates substantially commensurate with their feed rates. In a further preferred embodiment, controlled amounts of lubricant and gas are added to the mill at selected locations during the milling operation. Adding the lubricant and gas at selected locations is important for reasons to be explained hereinafter.

Metal particles which can be worked or formed into metal flake include atomized metal powder, chips, filings, borings and the like, the preferred particle form being atomized metal powder. Metals which may be provided in this form and which can be formed into flake include aluminum, nickel, iron, stainless steel and alloys such as bronze and brass.

Milling lubricant useful in the present invention includes longer chain fatty acids such as stearic acid, lauric acid, oleic acid, behenic acid with stearic acid being preferred for reasons of economics and efficiency during milling. Other lubricants, including tallow or mineral oil, may be used depending on end use requirements of the product flake.

In a preferred embodiment, when making aluminum flake from aluminum powder, a gas having a controlled amount of oxygen is added to the mill to prevent the formation of pyrophoric aluminum flake surfaces. That is, the oxygen in the gas reacts immediately with the newly formed aluminum flake surface to form aluminum oxide, thereby eliminating undesirable flake pyrophoricity.

With respect to the milling material, it is preferred to use generally spherical metal balls since they act to provide highly efficient grinding. Further, it is preferred that the metal in such balls is steel. The balls useful in the present invention typically range in size from 3/16 inch to ⅜ inch in diameter although in certain cases smaller or larger balls may be used depending to some extent on the starting material. The weight ratio of balls to metal particles generally employed ranges from about 50:1 down to as low as roughly 3:1. However, it is preferred to operate in the range of 6:1 to 12:1.

Figure 1:
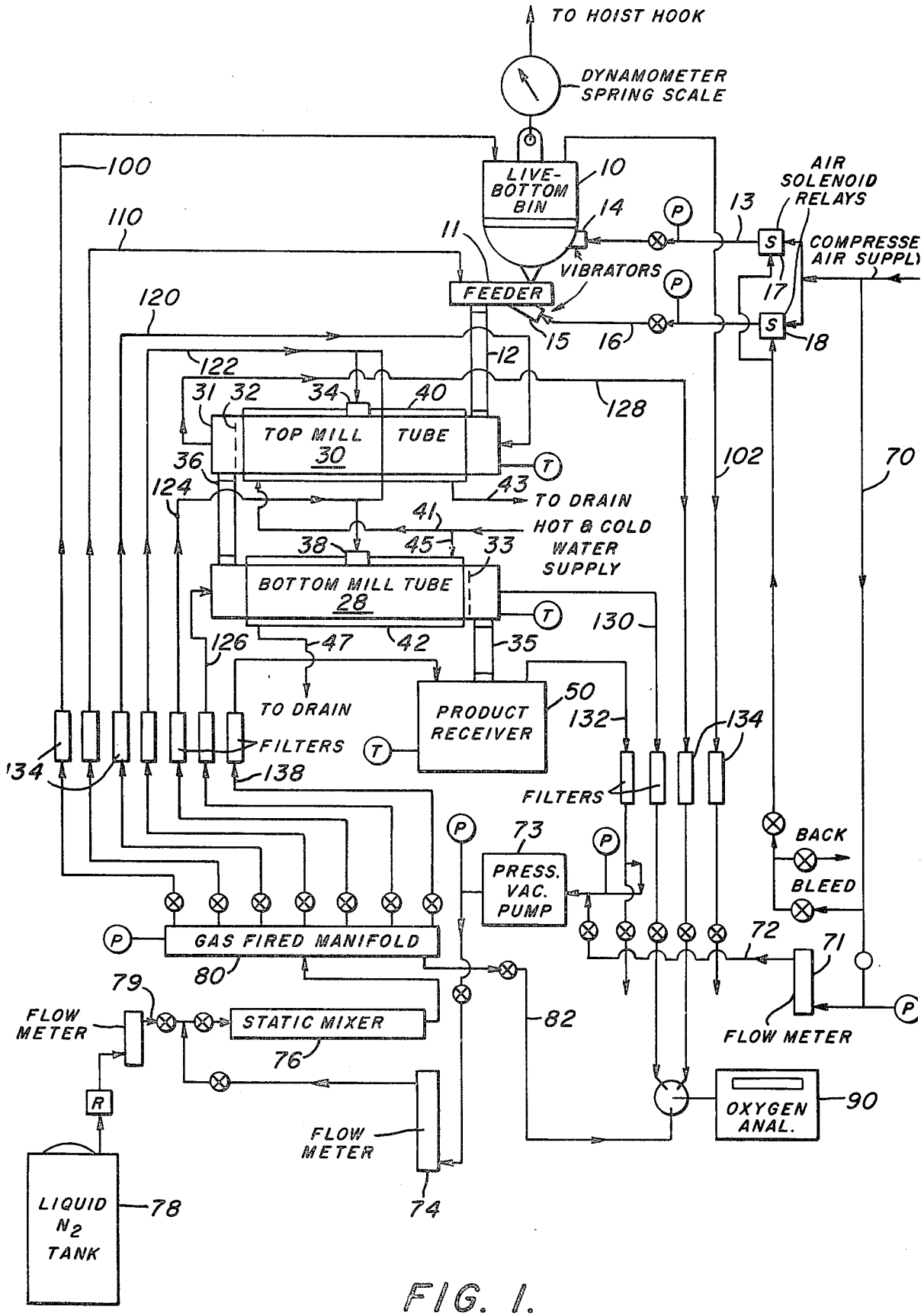
FIG. 1 is a schematic diagram illustrating a vibratory mill with metal flow parallel to gas flow through the mill in accordance with the invention.

In the process of the invention, metal particles are provided in a hopper or live bottom bin 10, FIG. 1, from where such particles can be passed through feeder 11 along conduit 12 to a vibratory mill having milling tubes 30 and 28. Metal flake produced in the mill passes or exits therefrom through conduit 35 to a container or product receiver 50. As shown in FIG. 1, hopper 10 may be suspended on a scale for purposes of regulating the rate of feed of metal particles to the mill. Because of problems which can occur with feed from hopper 10, such as bridging of the metal particles therein, vibrator 14 can be mounted on hopper 10 and activated to ensure a steady flow rate of feed. The vibrator may be activated or driven by compressed air as shown in FIG. 1. The compressed air is carried from the compressed air supply through pipe 13 to vibrator 14. In FIG. 1, feeder 11 is made to feed metal particles without interruption by means of vibrator 15 which may be driven by compressed air in the same way as vibrator 14. As shown in FIG. 1, compressed air is supplied to vibrator 15 from the compressed air supply through pipe 16. Air solenoid relays 17 and 18 are provided in pipes 13 and 16 for purposes of rapid starting and stopping of the vibrators.

The metal particles flow from feeder 11 to vibratory mill 30 through line 12. A vibratory mill which has been found highly suitable for milling in accordance with the present invention is referred to as a Palla mill, available from Humbolt Wedag, Div. of Deutz Corp., 1 Huntington Quadrangle, Huntington Station, N.Y. 11746. This particular mill, as noted, employs twin vertically counterbalanced tubes 30 and 28 for milling purposes as shown in FIG. 1 and is suitable for modification to preferred embodiments outlined in the procedures of the present invention. It should be noted that while a twin tube vibratory mill is shown, the present invention is not necessarily limited thereto. That is, for example, a single tube vibratory mill having the requisite capacity may be employed.

The present vibratory mill is capable of operating at rates which develop forces in the range of 7 to 10 g's. By comparison to a rotary mill, it will be noted that the higher milling forces in the vibratory mill increase its milling efficiency significantly. Also, it should be noted that vibratory mills can operate at milling media fillings amounting to 60 to 80% of the mill volume. By comparison, rotary mills normally operate at milling media fillings of 30 to 40% of their volume. The greater amounts of milling media operate to make the vibratory mill more efficient.

Figure 3:
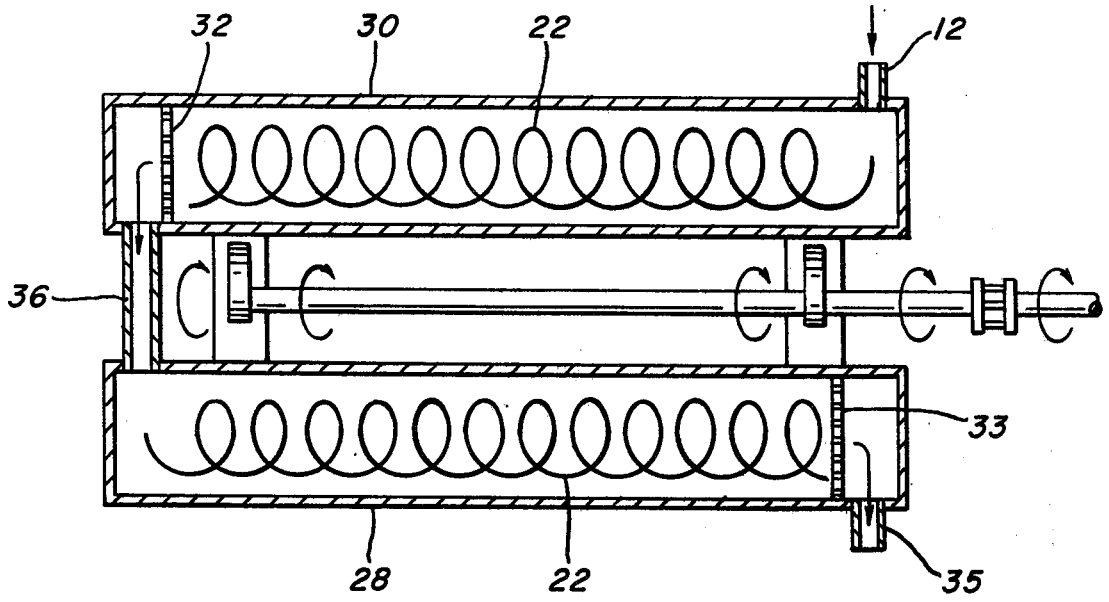
FIG. 3 is a schematic representation illustrating metal flow through the mill.

In the present mill, metal particles enter top mill tube 30 at conduit 12 and move in a generally spiral pattern by virtue of the vibratory motion or milling action to end 31 of the mill. The metal charge passes through grating 32 and along conduit 36 to bottom mill tube 28. Grating 32 serves to retain the grinding media, e.g. steel balls, in tube 30. The metal charge in bottom tube 28 moves from conduit 36 by virtue of the spiral milling action (FIG. 3) along tube 28, through grating 33 to exit or conduit 35 and henceforth to receiver 50. Thereafter, it may be stored or treated to enhance the properties of the flake as explained hereinafter.

The spiral milling action referred to may be compared to milling action in rotary ball mills. That is, instead of the continuous lifting of the ball mass against gravity so as to permit a steady free-fall rain against the opposite bottom wall, as in rotary mills, the vibratory mills of the present invention can be operated to provide a rapid series of direction changing impulses transverse to their axis which cause them to vibrate in circular orbit 22 (FIG. 3) of relatively limited amplitude due to the rotation of the adjustable unbalanced counterweights located on the drive shaft at each end of the mill tubes.

The grinding balls, or other media, thus receive a very rapid succession of direction-changing impact impulses. These impacts strike slightly sideways to the ball center, and, hence, the entire charge revolves slowly counterclockwise to the vibration action. Thus, the material undergoing milling passes through the grinding tube in a long spiral path, as indicated in the schematic shown in FIG. 3. This major prolongation of the flow path increases the effective retention time accordingly, and greatly increases the efficiency of milling—particularly for fine grinding operations.

The present metal flake producing system is designed primarily for operation on a continuous basis. That is, metal particles can be continuously fed to the mill and metal flake can be removed continuously. In such a continuous system, the extent of milling is controlled to a large extend by both the ball to metal particle ratio and by the residence time of the metal in the mill. For purposes of this invention, the residence time has a relatively fixed relationship to particular mill sizes, particularly the length of the mill tubes. Longer times may be obtained by several approaches: (1) selection of larger equipment, (2) superimposing additional shorter tube mills vertically over each other, or (3) multiple passing of semi-finished material through a smaller unit. Thus, fine, medium or coarse flake may be produced depending on the residency time. For purposes of producing aluminum flake for use as a sensitizer in explosives, a residence time of 0.5 to 20 hours should be employed with a preferred residence time being in the range of 8 to 16 hours. Such residence time can produce flake having a surface area ranging from 3.5 to 20 $m^2/gm$, with the preferred times producing flake ranging from 5 to 10 $m^2/gm$.

The system can be operated to accept metal particles having diameters of up to one inch and to comminute such particles to flake having sizes below 10 microns. However, to comminute or mill such particles requires controlled operation of the mill in order to avoid problems such as explosions due to lack of $O_2$ control or plugging of the mill resulting from excess lubricant, lack of temperature control, or welding of metal particles. Thus, it will be seen that control is necessary to operate the mill at maximum efficiency.

With respect to temperature control, it is preferred to operate at higher temperatures since this significantly improves the milling operation. At higher relative temperatures, lower levels of cold work or residual forming stresses are retained in the metal particles at any point so that further forming may progress against a softer, more malleable mass.

The addition of lubricant to the mill should be carefully controlled. That is, even though the total amount of lubricant used can be as much as 10% of the feed, its addition to the mill should be controlled so as to minimize agglomerations of metal particles, flake and lubricant occurring in the mill. It will be appreciated that at the entrance to the mill, the amount of lubricant required is low in comparison to that required after a period of milling and formation of new surface. Thus, if the amount of lubricant required initially is exceeded to a large degree, then plugging of the mill can result from the agglomerations.

It has been discovered that in milling aluminum particles, the lubricant, e.g. stearic acid, can be present initially in an amount which constitutes about 0.7 to 1.5 wt.% of the feed. The lubricant may be added independent of the metal particles, but preferably for purposes of the present invention, it should be mixed with the metal particles prior to being introduced to the mill. In a more preferred embodiment, the required amount of stearic acid is first melted and held at a temperature above its melting point. Thereafter, the metal particles are added and the mass is mixed to effect coating of the entire metal surface with a thin coating of molten stearic acid. After cooling to room temperature, the metal particles retain a coating of solid stearic acid relatively uniformly distributed over their surfaces. Since such coated particles are free-flowing, they can be fed through hopper 10. It should be understood that this amount of lubricant is sufficient to satisfy the surface area requirements of the feed initially. However, as the milling operation progresses, comminution of the particles results in increased surface area which requires more lubricant. Just as an excess of lubricant can present problems initially, operating the mill with a deficiency of lubricant can also present problems. If the charge is deficient in lubricant the comminution process can be reversed. That is, a deficiency of lubricant can result in the particles welding together. This condition is illustrated in Example 9, following. Thus, in milling aluminum particles in the mill depicted in FIG. 1 wherein stearic acid is added to constitute 0.75 to 1.5 wt.% of the feed, additional stearic acid should be added at points 34, 36, 38 or at about ¼ lengths along the mill. The additions of lubricant should be in sufficient quantity to maintain an excess thereof in the range of 0.7 to 1.5 wt.% and preferably in the range of 0.7 to 1.3 wt.%.

From FIG. 1, it will be observed that water jackets 40 and 42 are provided around top mill tube 30 and bottom mill tube 28 for purposes of controlling the temperature of the mill. Hot or cold water, as required, can be supplied to jacket 40 along pipe line 41 and removed through pipe line 43. Water is supplied through pipe line 45 to jacket 42 and removed therefrom through pipe line 47. By sensing the temperature of the mill, the water flow through the jackets can be automatically controlled to provide the requisite temperatures for optimum milling efficiency. For purposes of the present invention, milling action should be carried out at temperatures in the range of 125° to 175° F.

An important aspect of the present invention is the controlled gaseous atmosphere maintained within the mill. Preferably the controlled gaseous atmosphere comprises an inert gas and an oxidizing gas. Preferably, the inert gas is nitrogen and the oxidizing gas is oxygen. The oxygen content of gas within the mill should be maintained in the range of 7 to 11 vol.% and preferably in the range of 8 to 10 vol.%. A low oxygen content can result in a flake surface which is insufficiently oxidized resulting in an unstable condition when the flake is subsequently exposed to air. Such pyrophoric flake will immediately react with the large excess of oxygen in the air and burning or an explosion usually ensues. On the other extreme, oxygen contents exceeding the upper limits can result in explosions within the milling or collection systems due to rapid oxidation of the contained dust clouds. The minimum explosive concentration of oxygen in nitrogen diluent gas in an aluminum powder dust cloud has been determined to be approximately 10% in moderate concentration of aluminum powder (Reference: George Long, "Preventing Aluminum Powder Dust Cloud Explosions", Ind. & Eng. Chem. 53, 823, Oct. 1961). In the present system, due to the supersaturation of aluminum powder fuel in the mill, the 10% limit may be exceeded slightly since the gas flow is low. However, it should be noted that these limits normally only hold for nitrogen-oxygen mixtures. If flue gas, nominally nitrogen-carbon dioxide-carbon monoxide-oxygen, or carbon dioxide alone is employed as the gas, the applicable explosive limit can be several percent lower. Because of the residence times employed and the low gas flow rates employed, the oxygen content of the gaseous atmosphere can be depleted as the milling process proceeds.

In the present invention, the gas flow rate through the mill should be controlled sufficiently low so as not to remove metal flake prematurely. That is, if the gas flow rate is permitted to increase beyond certain limits, it will be found that a certain amount of flake will be moved in the flow direction of the gas, interfering with the milling operation by creating an imbalance in flow rates. Also, large flow rates can result in excessive dust clouds which greatly increase the possibility of explosion. Thus, for purposes of the present invention, the gas flow rate should not be more than 7 $ft^3$/min per square foot of milling tube cross-sectional area, with a preferred gas flow rate being in the range of 3 to 5 $ft^3$/min.

With respect to maintaining the oxygen content in the mill in the ranges noted above, the gas should be introduced at supplemental points along the length of the mill. Also, in order that the oxygen concentration be maintained within these limits, gas should be removed at certain points along the mill and analyzed. In order to describe the system of addition and removal of gas in accordance with one embodiment of the invention, reference should be made to FIG. 1. Air is supplied along line 70, through flow meter 71, along line 72, joining return flow through line 132 from receiver 50. Then, it is passed through pressure vacuum pump 73 to a second flow meter 74 and hence to static mixer 76. Nitrogen is supplied from source 78 along line 79 and is combined with air and return gas. The nitrogen diluent lowers the oxygen content of the air and return gas to the range noted above. The nitrogen-air mixture, hereinafter referred to as gas, is passed to manifold 80 for purposes of distribution to the mill. A stream of gas can be bled from manifold 80 along line 82 to oxygen analyzer 90 to ensure that the starting gas has the correct amount of oxygen. To provide a controlled atmosphere throughout the system, gas can be provided along line 100 from manifold 80 to hopper 10. Line 102 recirculates gas from hopper 10 to analyzer 90 to ensure against oxygen build-up in the feed. Also, gas is provided to feeder 11 along line 110 from manifold 80 to further permit purging of the system. Lines 120, 122, 124 and 126 provide gas from manifold 80 to mill tubes 30 and 28 substantially as shown in FIG. 1. Gas is withdrawn from top mill tube 30 along line 128 and from bottom mill tube 28 along line 130 to analyzer 90. Gas is circulated from manifold 80 along line 138 to product receiver 50 and back along line 132 to manifold 80, as noted earlier. Withdrawing and analyzing the gas at these locations permits adjustments in gas feed rates to ensure a controlled atmosphere within the mill. Filters, generally referred to as 134, are provided in the gas lines to remove dust or flake. Pressure and temperature gauges provided in the system are denoted by "P" and "T", respectively.

Figure 2:
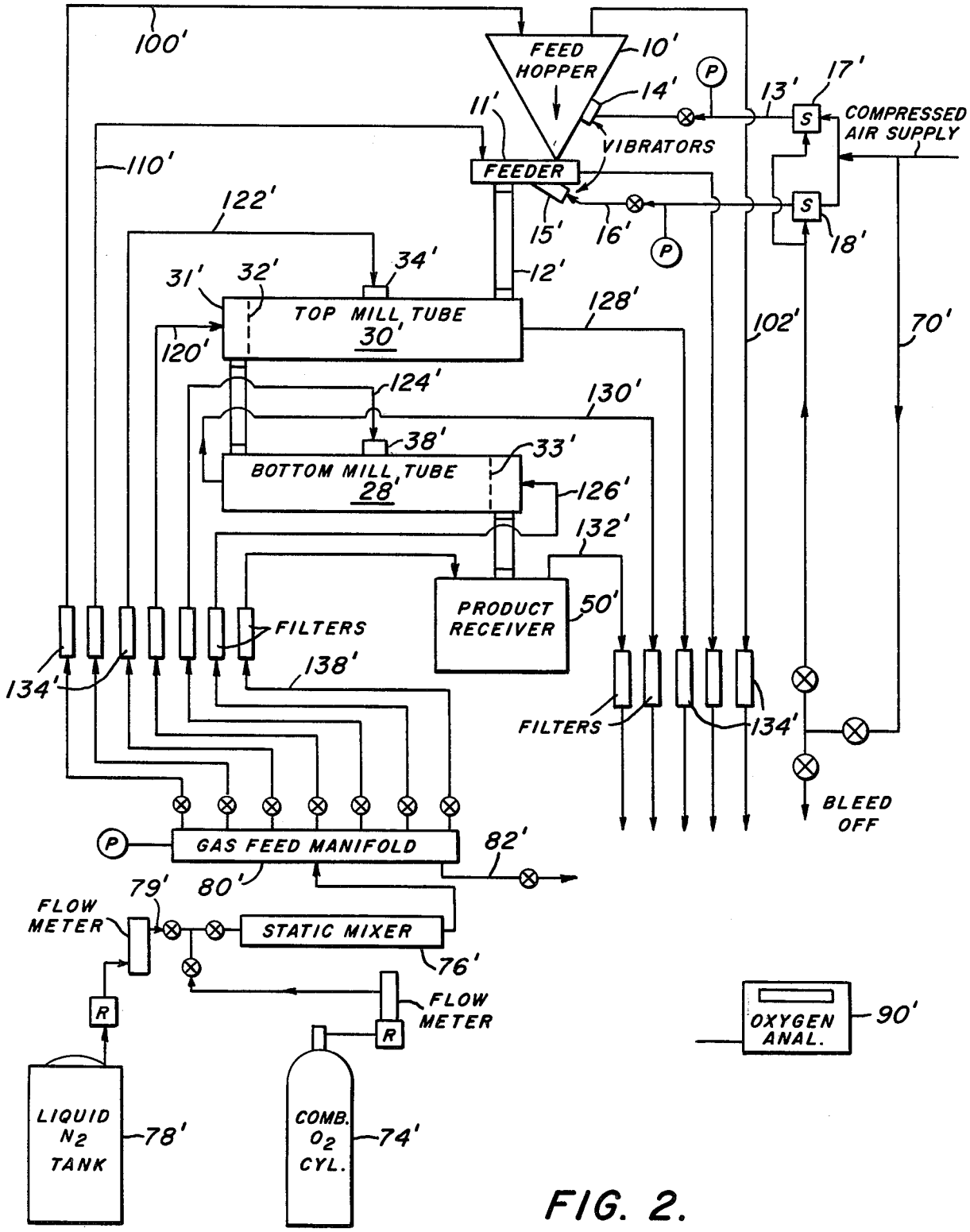
FIG. 2 is a schematic diagram as in FIG. 1 except the gas flow is shown counter-current to the metal flow.

In FIG. 1, the gas flow has been set up to provide generally parallel flow with the metal flow. However, as will be noted by inspection of FIG. 2, the gas flow can be counter-current to the flow of the metal during the milling process. In FIG. 2, elements similar to those described in FIG. 1 have similar numbers except the numbers in FIG. 2 are provided with a prime, e.g. feed hopper of FIG. 2 is 10'. By inspection of FIG. 2, it will be observed that the gas is introduced to tube 30' at end 31' and removed at the opposite end thereof. Similarly, gas is introduced to tube 28 at its exit end and removed at the opposite end. As noted earlier, the gas flow rates are sufficiently low so as not to interfere with the flow of metal.

It should be noted that while the milling has been referred to using an oxygenated gas, the present system can be operated employing vapors from reactive organic materials disclosed in U.S. Pat. No. 3,890,166, incorporated herein by reference.

The present invention is advantageous in that large volumes of gas flow are not required to remove metal flake from the mill. This permits the use of smaller, safer lower cost devices such as pressure-vacuum pumps for gas circulation and eliminates the need to employ hazardous dust collectors. The low flow rates employed permit the use of simple settling chambers for flake collection. As noted, large gas flow rates can lead to dust explosion. In addition, large gas flow rates remove only the smaller flakes permitting an accumulation of larger particles in the mill. It will be appreciated that a build-up of metal particles in the mill interfers with the milling process by, for example, changing the metal ball to metal particle ratio.

The following examples are still further illustrative of the invention.

EXAMPLE 1

Aluminum flake was produced in accordance with the invention in a Palla 20U model vibratory mill, the tubes of which were 8 inches in diameter and 51 inches long. The mill was operated with open-circuit gas flow substantially as shown in FIG. 2. Alcoa grade 124 atomized powder containing 2.5 wt.% stearic acid of 97% purity was added at a rate of 13 lbs/hr. The mill employed a 520 lb. charge of steel balls having ¼ inch diameter. The ball-to-metal ratio in the mill was about 10:1. Nitrogen was passed through the mill at a rate of 0.8 $ft^3$/min and oxygen at a rate of 0.11 $ft^3$/min in a direction counter-current to the flow of metal. The mill was operated at a speed of 1500 rpm and at a mill vibration diameter of 0.2 to 0.24 inch for a milling period of 4 hours. Aluminum flake, 30% of which had a size of +100 mesh (Tyler Series) and 20%, a mesh size of −325, was produced.

EXAMPLE 2

This example was the same as Example 1 except the gas flow was in the direction of metal flow. Substantially the same type of aluminum flake was produced.

EXAMPLE 3

Aluminum flake was produced in the mill of Example 1 with the gas flow being in a closed circuit and being parallel to the metal flow, substantially as shown in FIG. 1. The gas was comprised of nitrogen and air. Nitrogen flow rate to the mill was 0.33 $ft^3$/min and air flow ranged from 0.2 to 0.37 $ft^3$/min. Alcoa grade 124 atomized powder containing 1.25 wt.% stearic acid (80% purity) was added at a rate of 12 lbs/hr. The ball charge in the mill was 470 lbs (¼ inch diameter balls) and the ball-to-metal ratio was 9.9:1. The mill was operated at 1000 rpm and at a mill vibration diameter of 0.39 to 0.474 inch for a milling period of 4 hours. Of the flake product produced, 31.3% had a size of +100 mesh and 20.4% had a size of −325 mesh (Tyler Series).

EXAMPLE 4

This example was the same as Example 3 except the powder was milled for a total residence time of 8 hours and 1.25 wt.% stearic acid was added to the mill after 4 hours of milling. Of the aluminum flake produced, 19.0% had a size of +100 mesh and 25.3% had a size of −325 mesh (Tyler Series). The flake had a total surface area of 2.6 $m^2$/gm. Also, 74.4% of the flake was less than 75 microns. The flake had a median particle size of 22.6 microns.

EXAMPLE 5

This example was the same as Example 3 except the powder was milled for a total residence time of 12 hours. Aluminum powder containing 1.25 wt.% stearic acid was added to the mill and 1.25 wt.% stearic acid was added after 4 hours of milling. After 8 hours of milling, 2.75 wt.% of the stearic acid was added. 91.4% of the flake produced had a size less than 75 microns. Also, only 6.6% had a size of +100 mesh and 44.6% had a size of −325 mesh (Tyler Series). The median particle size was 22.6 microns. The flake had a total surface area of 5.2 $m^2$/gm.

EXAMPLE 6

This example was the same as Example 3 except the powder was milled for a total of 16 hours residence time. For the first 12 hours of milling the stearic acid was added as in Example 5. After 12 hours, the amount of stearic acid added was 1.0 wt.% of the feed. 96.6% of the flake was less than 75 microns and the median particle size was 20.3 microns. Only 2.3% of the flake had size of +100 mesh and 69.5% had a size of −325 mesh (Tylor Series). The flake had a surface area of 6.5 $m^2$/gm.

EXAMPLE 7

This example was the same as Example 6 except the mill was operated for a period of 20 hours and 1.0 wt.% stearic acid was added after 16 hours of milling. After 20 hours of milling, 99.5% of the flake had a size of less than 75 microns and the median particle size was 16.5 microns. Only 1.6% of the flake had a size of +100 mesh and 77.4% had a size of −325 mesh (Tyler Series). The flake had a surface area of 8.9 $m^2$/gm.

EXAMPLE 8

Aluminum flake was produced as in Example 3 except the feed rate was 10 lbs/hr, the ball-to-metal ratio was 11.8:1 and air flow rate was 12.7 to 18.6 SCFH. The powder was milled for a total residence time of 16 and 20 hours, respectively. After each 4 hours of milling, stearic acid (97% purity) was added in the amount of 1.25 wt.% of feed. In this example, the mill temperatures were held in the range of 95° to 122° F. by use of water jackets mounted on the tubes. After 16 hours of milling, only 1.7% of the flake had a size of +100 mesh and 72.7% had a size of −325 mesh (Tyler Series). Also, 97.2% of the flake was less than 75 microns. The flake had a median particle size of 13.4 microns and a surface area of 14.3 $m^2$/g.

After 20 hours of milling, only 1.1% of the flake had a size of +100 mesh and 80.6% had a size of −325 mesh (Tyler Series). In addition, all of the flake was less than 75 microns. The flake had a median particle size of 11.8 microns and a surface area of 16.6 $m^2/g$.

The flake, milled for 16 hours, was tested in a blasting formulaton for minimum cap sensitivity. It was found that the blasting formulation required 3 wt.% of this flake in order to be responsive to a #6 electric blasting cap. It was also found that 4% of the flake milled for 20 hours was required in the blasting formulation to be responsive to a #6 electric blasting cap.

The sensitizing action of the aluminum flake was assessed in the following blasting formulation:

| | |
|---|---|
| Ammonium nitrate | 59.5 parts by weight |
| Water | 28.7 |
| Aluminum powder | 10.0 |
| Guar gum | 1.5 |
| pH buffer (phosphate) | 0.3 |

A suitable guar gum is Guartec 185, available from General Mills (Minneapolis, Minn.). After mixing, this formulation has a density of 1.05 to 1.10 g/cc, and a pH of 4.5. It is packed into polyethylene tubes 1¼ inches in diameter and 16 inches long, using a cardboard tube to assure a uniform diameter along the entire length. In the charge thus prepared, aluminum powder, e.g. Alcoa grade 120, was replaced by 3 and 4 wt.% aluminum flake, respectively, as noted above.

EXAMPLE 9

A 1-liter capacity stainless steel cylinder was employed as a batch-type milling chamber. Milling media consisted of 1485 g. stainless steel balls, and vibratory shaking energy was provided by a Red Devil mixer (model 5110). In three separate experiments, 35.0 g. Alcoa grade #120 atomized powder was milled in $O_2$ gas at a pressure of one atmosphere. In one experiment, no lubricant was used. In the second experiment, 1.75 g. stearic acid was employed as lubricant, and, in the third experiment, 1.75 g. mineral oil served as lubricant. Each was milled for a period of 3 hours. After milling, residual vacuum inside the mill was measured, and bulk density of the product powder was determined. The results are summarized in Table 1.

Table 1

| Experiment No. | Lubricant | Vacuum Generated During Milling | Bulk Density of Product Powder |
|---|---|---|---|
| 1 | None | 7 inches Hg | 1.82 g/cc |
| 2 | 5% stearic acid | 27 inches Hg | 0.60 g/cc |
| 3 | 5% mineral oil | 27 inches Hg | 0.57 g/cc |
| #120 atomized powder, not milled | | | 1.61 g/cc |

In Table 1, 30 inches Hg represents development of full vacuum. The data illustrates that, in the absence of lubricant, very little $O_2$ is consumed and the bulk density is greater than that of the unmilled powder feedstock. The product powder from Experiment #1 is granular in nature, and visually has a welded appearance. The increase in bulk density also indicates that welding, rather than comminution, occurred in the mill. In contrast, both experiments in which a lubricant was present resulted in almost complete consumption of the available $O_2$. The light, fluffy product powder was visually well comminuted, which is reflected by the bulk density measurements.

This example illustrates that, in the absence of a lubricant or "parting compound", welding occurs under conditions of dry milling even when sufficient oxygen is present to react with newly-generated surfaces. Thus, it can be seen that, should lubricant not be well distributed throughout the mill, welding rather than comminution will occur in lubricant-starved regions of the mill.

EXAMPLE 10

The batch-type milling equipment of Example 9 was again employed. In each of three experiments, 30.0 g. #120 atomized powder, pre-coated by melt-mixing with 0.6 g. stearic acid, was milled in identical fashion with one atmosphere $O_2$ sealed into the mill. After milling 45 minutes, the mill was opened, 0.3 g. stearic acid and one atmosphere $O_2$ were added, and the mill was re-sealed. The contents were milled an additional 45 minutes.

In one experiment, the product powder was not treated further. In the second experiment, the product powder was polished for 15 minutes in a closed steel cylinder in which brushes rotated against the inside cylinder surface. In the third experiment, the product power was polished for 3 hours in the same manner. Covering capacity on water of these experimental products was then measured according to accepted industry practice (see Aluminum Paint and Powder, J. D. Edwards and R. E. Wray, pp. 18–20, Reinhold Publishing Corp.). In this test, aluminum flakes float and spread on the surface of water and are compacted to form a void-free coating. The area covered is then measured. The results are summarized in Table 2.

Table 2

| Experiment No. | Polishing Time | Apparent Covering |
|---|---|---|
| 4 | None | 3,700 $cm^2/g$. |
| 5 | 15 minutes | 7,700 $cm^2/g$. |
| 6 | 3 hours | 11,900 $cm^2/g$. |

The significance of these results in that the dry milled product is highly agglomerated. The polishing action of the brushes separates aluminum particles one from another, and it is readily seen that the product powder of experiment #6, which had been milled in identical fashion to the product of experiment #4, has three times more covering capacity. Thus, polishing has deagglomerated the dry-milled flakes, allowing the same weight of product to form a thinner film covering more area. After only 15 minutes polishing time (experiment #5), covering capacity increased by a factor of two, indicating that, to a large extent, these agglomerates are soft and can easily be broken apart. Centrifugal gas-phase classification, using equipment such as that manufactured by Majac Div. of Donaldson Company, Inc., is another method for deagglomerating dry-milled powder.

Care must be taken that milling not continue for too long a period, however, because continued pounding of these agglomerates by the milling media eventually results in cold welding, or irreversible agglomeration. Such product powders contain high levels of oxide, much of it internal to the agglomerate, and are less desirable for use as pigments or explosive sensitizers.

From the description and the above examples, it can be seen that aluminum flake can be made safely and economically in a vibratory mill. Also, it will be noted that because of the rather low gas flow rates, the gas can flow either parallel or counter-current to the flow of metal through the mill. In addition, the examples show that by this method of milling, the particle size is, to a large extent, determined by the milling time.

While the invention has been described in terms of preferred embodiments, the claims appended hereto are intended to encompass other embodiments which fall within the spirit of the invention.

Having thus described the invention and certain embodiments thereof, we claim:

1. A continuous method of making metal flake in a ball mill comprising the steps of:
   (a) feeding a charge of metal particles substantially continuously to a vibratory mill containing milling material;
   (b) supplying a controlled amount of lubricant to the mill to avoid formation of agglomerations in amounts which would hinder metal particle flow;
   (c) feeding a supply of gas to the mill, the gas feeding being controlled to a rate which avoids substantial interference with metal particle flow through the mill;
   (d) milling the metal particles in the presence of the gas to form metal flake, the milling being controlled so as to substantially eliminate welding of the metal particles;
   (e) moving the particles through the mill by use of the vibratory milling action; and
   (f) removing metal flake and gas from the mill at a rate substantially commensurate with feed rate.

2. The method according to claim 1 wherein the gas contains an inert gas and a gas capable of chemically combining with the metal.

3. The method according to claim 2 wherein the gas capable of chemically combining with the metal surface is oxygen.

4. The method according to claim 1 including the step of exposing the flake to oxygen to form a coating thereon to render the particles non-pyrophoric.

5. The method according to claim 1 wherein the metal particles employed are aluminum.

6. The method according to claim 1 wherein the inert gas is nitrogen.

7. The method according to claim 1 wherein the lubricant is stearic acid.

8. The method according to claim 7 wherein the amount of stearic acid employed at the start of the milling process is 0.75 to 1.5 wt.% of aluminum particles charged to the mill.

9. The method according to claim 1 wherein the lubricant is mixed with said metal particles prior to their being fed to said mill.

10. The method according to claim 1 wherein stearic acid is maintained in the mill in the range of 0.7 to 1.3 wt.%.

11. The method according to claim 8 wherein stearic acid is added at points along the length of the mill to replenish stearic acid depleted due to said milling process.

12. The method according to claim 1 wherein said mill is operated at a temperature in the range of 125° to 175° F.

13. The method according to claim 1 wherein the gas is passed through said mill in the direction of the metal flow.

14. The method according to claim 1 wherein the gas has a maximum flow rate through the mill of 7 $ft^3$/min.

15. The method according to claim 1 wherein the gas has a flow rate through the mill in the range of 3 to 5 $ft^3$/min.

16. The method according to claim 1 wherein the gas is passed through the mill in a direction substantially opposite to the direction of metal flow.

17. The method according to claim 1 wherein the oxygen content of the gas is maintained in the range of 8 to 10 vol.%.

18. The method according to claim 1 including the step of deagglomerating the metal flake thereby increasing the covering capacity of the flake product.

19. The method according to claim 17 wherin gas is added along the length of the mill to replenish oxygen depleted as a result of said milling process.

20. The method according to claim 1 wherein the mill employs a residence time in the range of 0.5 to 20 hours.

21. The method according to claim 1 wherein the metal flake produced has a surface area in the range of 3.5 to 20 $m^2$/gm.

22. A method of making aluminum flake in a ball mill comprising the steps of:
   (a) providing aluminum particles in a mix containing 0.75 to 1.5 wt.% stearic acid;
   (b) feeding the mix substantially continuously to a vibratory ball mill;
   (c) supplying a gas containing nitrogen and 8 to 10 vol.% oxygen to the mill, the gas being supplied at a rate not greater than 7 $ft^3$/min and having a flow direction in the direction of metal flow;
   (d) milling the aluminum particles in said vibratory mill for a residency period in the range of 0.5 to 20 hours to form aluminum flake having a surface area in the range of 3.5 to 20 $m^2$/gm and moving the particles through the mill by use of the vibratory milling action;
   (e) maintaining said mill during said milling at a temperature in the range of 125° to 175° F.;
   (f) adding stearic acid and gas to partially milled aluminum to replenish stearic acid and oxygen depleted as a result of the milling;
   (g) removing aluminum flake from the mill at a rate substantially commensurate with the metal particle feed rate; and
   (h) removing the gas from the mill at a rate substantially commensurate with the gas feed rate.

23. The method according to claim 1 wherein the material supplied to the mill in step (b) is a parting compound.

* * * * *